US005391116A

United States Patent [19]

Burkholder et al.

[11] Patent Number: 5,391,116

[45] Date of Patent: Feb. 21, 1995

[54] GUIDE FINGER FOR A PINSETTER

[75] Inventors: Roy A. Burkholder, Whitehall; Ted Brim, Grand Haven, both of Mich.

[73] Assignee: Brunswick Bowling & Billiards, Muskegon, Mich.

[21] Appl. No.: 107,924

[22] Filed: Aug. 17, 1993

[51] Int. Cl.[6] ..... A63D 5/00

[52] U.S. Cl. ..... 473/73; 473/89; 473/96

[58] Field of Search ..... 473/64, 73, 87, 88, 473/89, 90, 94, 96; 285/211, 405, 411, 423; 411/166, 169, 107, 955

[56] References Cited

U.S. PATENT DOCUMENTS

| | | | |
|---|---|---|---|
| 923,890 | 6/1909 | Puffer | 285/423 |
| 4,234,182 | 11/1980 | Camilleri | 473/94 |
| 4,372,566 | 2/1983 | Smith | 280/11.28 |
| 4,443,022 | 4/1984 | Ware | 280/11.28 |
| 4,931,683 | 6/1990 | Gleixner | 411/166 |

OTHER PUBLICATIONS

Brunswick Parts Catalog, Nov. 1961.

*Primary Examiner*—Mark S. Graham
*Assistant Examiner*—William M. Pierce
*Attorney, Agent, or Firm*—Wood, Phillips, VanSanten, Clark & Mortimer

[57] ABSTRACT

An improved guide finger 18 is provided to simplify the installation of guide fingers in pinsetters 10 used in bowling centers, having a mounting plate 24 and a guide plate 26, with the mounting plate having a plurality of mounting apertures 30 equipped with hexagonal sockets 32 for receiving the head of a machine bolt, the mounting aperture 30 is provided with a metal insert 38 and the guide finger 18 is preferably made of nylon.

4 Claims, 2 Drawing Sheets

FIG. 6
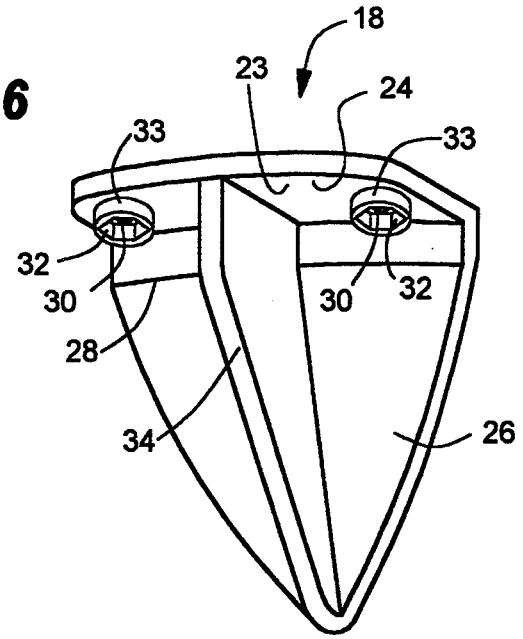
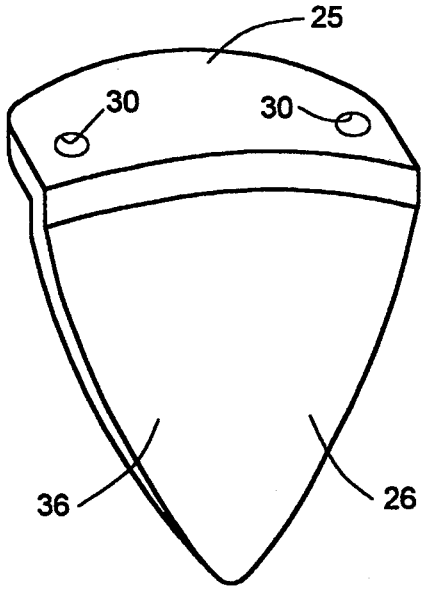
FIG. 7
FIG. 8
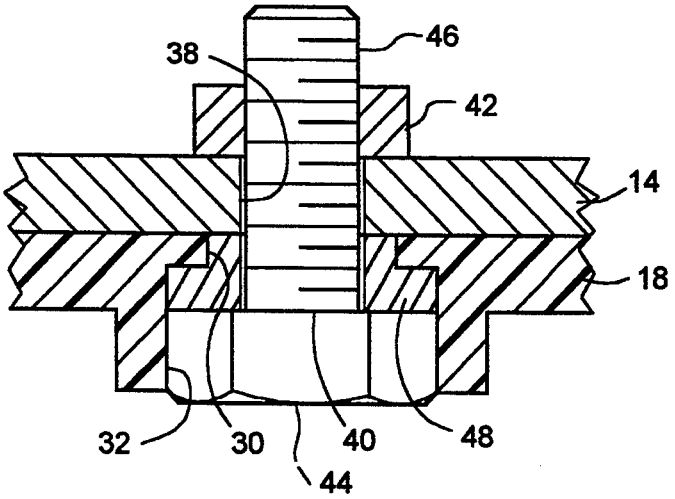

GUIDE FINGER FOR A PINSETTER

BACKGROUND OF THE INVENTION

1. Field of the Invention

This invention relates to guide fingers for pinsetters as used in bowling centers.

2. Background of the Invention

Bowling centers use pinsetters to automatically clear a bowling lane and reset the pins after the bowling ball has been rolled. Pinsetters are complex mechanical devices consisting of a large number of parts. A guide finger is part of a pinsetter and is used to guide the pin down a deck chute into the pin setting position.

Currently most guide fingers are made from aluminum. Occasionally pins jam the deck area of the pinsetter, and the rigidity of the aluminum fingers can cause damage to the deck.

Some guide fingers are made of polyurethane. This has proved to be unsatisfactory because the polyurethane is too flexible to properly spot the pins.

The guide finger typically has a countersunk mounting site. A flat head machine bolt and associated nut are used to mount the guide finger to the pinsetter. Due to the number of parts making up the pinsetter and the location of the guide finger it is difficult to hold a wrench on the head of the flat head bolt while tightening the nut. This results in guide fingers being burdensome to install.

The present invention is directed to overcoming one or more of the above problems.

SUMMARY OF THE INVENTION

It is an object of this invention to provide an improved guide finger for pinsetters. More specifically, it is an object of the invention to provide a guide finger that is easily installed and reduces the frequency of pins jamming in the deck area.

An exemplary embodiment of the invention that achieves these objects has a mounting plate, with one edge of the mounting plate connected to an edge of a guide plate which extends at a substantially acute angle to the mounting plate. The guide plate and mounting plate can be molded from a single block of material. The mounting plate has mounting apertures outfitted with hexagonal bolt receiving sockets. The mounting plate and guide plate are mounted to a deck of the pinsetter using machine bolts and associated nuts. The sockets receive and engage a standard hexagonal bolt head and prevent the bolt from turning when the nut is attached. This allows a mechanic to install the guide finger without having a wrench to hold the bolt head in place.

In a preferred embodiment, the mounting plate and the guide plate are fabricated out of nylon. The nylon provides a slick, smooth, low friction surface in contact with the pins and also allows the guide finger to flex slightly. This reduces the frequency of pin jams in the deck area of the pinsetter. The nylon also is somewhat yieldable which allows the bolt head to rotate in the socket when the bolt is excessively torqued to prevent over tightening to the point where damage to the mounting plate occurs.

Preferably, the mounting apertures have a metal liner. The metal liner prevents the nylon of the mounting plate from being crushed or cracked when the bolt is tightened excessively.

Other objects and advantages will become apparent from the following specification taken in connection with the accompanying drawings.

DESCRIPTION OF THE DRAWINGS

FIG. 6 is a perspective view of a guide finger.

FIG. 7 is a perspective view of the guide finger from the pin engaging side of the guide finger.

FIG. 8 is a fragmentary sectional view of a deck aperture and a mounting plate aperature, equipped with a hexagonal socket, held together by a machine bolt and a nut.

DESCRIPTION OF THE PRIOR ART

Figure 1:
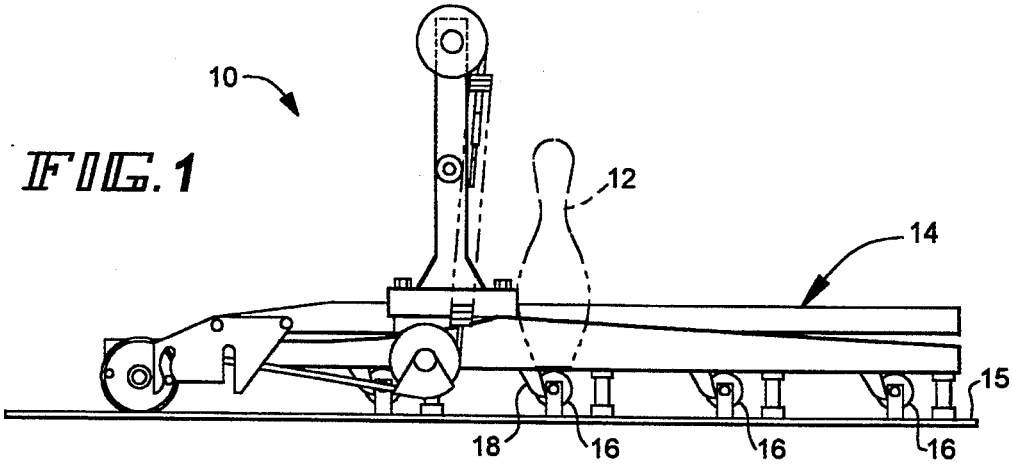
FIG. 1 is a fragmentary side elevation of a pinsetter, and specifically the deck thereof.
Figure 2:
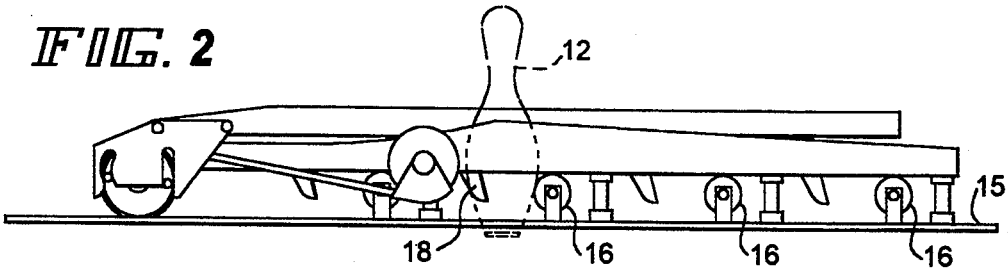
FIG. 2 is a fragmentary side elevation of the pinsetter of FIG. 1 illustrating the movement between a moving deck and a scissor deck.
Figure 3:
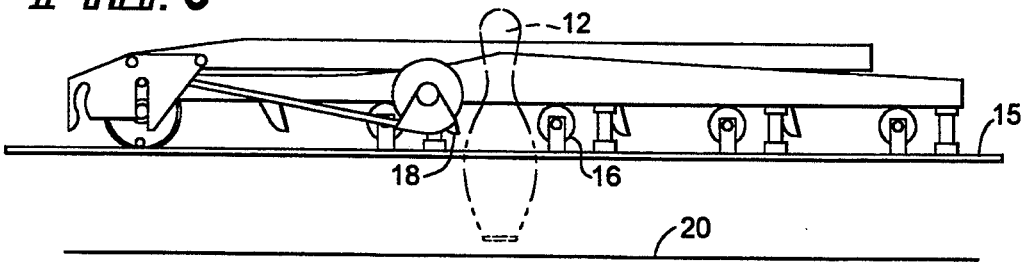
FIG. 3 is a fragmentary side elevation of the pinsetter of FIG. 1 illustrating a pin release position.

FIG. 1 shows part of a pinsetter 10, specifically a Brunswick model A-2 pinsetter of well known construction. In an A-2 pinsetter, pins 12 (only one of which is shown) are received in respective pin stations to be described hereinafter and located in a vertically movable deck 14. A so called scissor deck 15 is located below the deck 14 and is vertically movable therewith. The movable deck 14 is also horizontally movable relative to the scissors deck 15 which carries a plurality of rollers 16, one for each pin station, on its upper surface for normal disposition under each pin station to support the corresponding pin 12 as shown in FIG. 1.

The scissor deck 15 also has a pin setting opening 17 (FIG. 4 and 5) for each pin position that may be brought into registry with the corresponding pin station by moving the movable deck 14 relative to the scissors deck 15 during the pin setting process. As the deck 14 lowers it moves rearward and the pins 12 begin to slide down the side of roller 16 and are confined between the roller 16 and the guide finger 18. As the movable deck 14 continues to move rearward the pins 12 slide into pin setting openings 17. Finally, as the movable deck 14 is moved all the way rearward, the pins 12 are gently placed on the lane surface 20. The decks 14 and 15 are raised a distance above the top of pins 12. The pinsetter 10 is now ready for the bowler to roll the next bowling ball.

After the ball is rolled, fallen pins 12 are picked up by a part of the pinsetter 10 not shown and distributed to respective ones of the pin stations. The pin stations have a deck chutes 22 which receive the pins 12 and align the pins 12 on the rollers 16 and the whole process begins again in a conventional fashion well known to those familiar with the Brunswick A-2 pinsetter. Since this part of pinsetter operation is conventional and forms no part of the invention disclosed herein, it will not be described.

FIG. 6 shows an enlarged perspective view of the guide finger 18 which is the subject of this invention. The view shows the underside of the guide finger 18 which has a mounting plate 24, with a lower surface 23 and an upper surface 25, shown in FIG. 7. The mounting plate 24 is at a substantially acute angle to a guide plate 26 and integrally connected at an edge 28. In one embodiment, a 76 degree angle is chosen.

Figure 4:
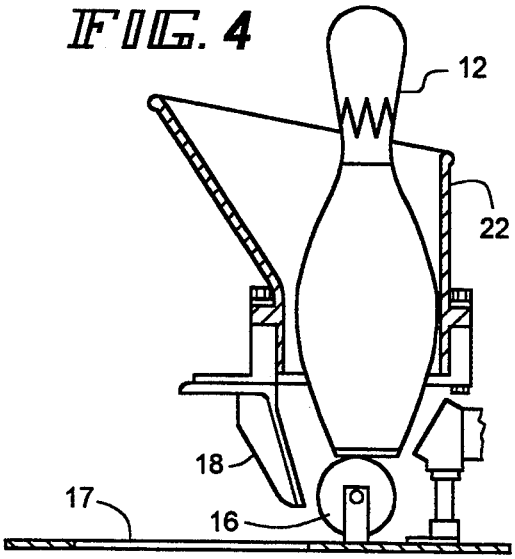
FIG. 4 is an enlarged cross sectional view of the pin in FIG. 1.
Figure 5:
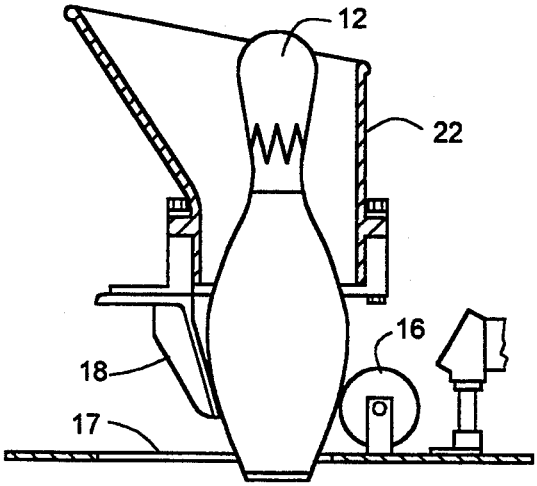
FIG. 5 is an enlarged cross sectional view of the pin in FIG. 2.

The guide finger 18 has a pair of mounting apertures 30 equipped with hexagonal sockets 32 in the lower surface 25 of mounting plate 24. The hexagonal sockets snugly receiving the head of a machine bolt (not shown). These sockets 32 keep the machine bolt from turning when the bolt is tightened to mount the guide finger 18 to the moving deck 14 as seen in FIG. 4. The guide finger 18 also has a rigidifying rib 34 attached to the guide plate 26 and the mounting plate 24.

FIG. 7 shows a frontal perspective of the guide finger 18. A surface 36 of the guide plate 26 engages and guides the pins (not shown) onto the lane surface 20. Preferably, the surface 36 is U shaped and is part of a concave conical surface to provide some confinement of a pin 12 as it is lowered onto the underlying lane 20. The guide finger 18 according to this invention is preferably molded of nylon ST801. This provides the guide finger 18 with a slippery smooth surface 36. The nylon allows the finger 18 to flex sightly without deforming. When the finger 18 is made of nylon and the hexagonal socket 32 is provided with enough support material 33 the "give" in the nylon material will allow the hexagonal machine bolt head to rotate within the socket 32 when over torqued without permanently deforming the socket 32.

The guide finger 18 produced according to the invention provides a finger 18 which is easily installed without the need for a wrench to hold the bolt's head. The nylon material provides a slick, smooth, low friction surface to guide the pins 12 and reduce the number of pin jams. If the bolt head is overly torqued the head rotates in the socket 32 without permanently deforming the socket 32.

FIG. 8 shows a cross section of the mounting aperture 30 equipped with the hexagonal socket 32. The mounting aperture 38 of the deck 14 is aligned with the mounting aperture 30 of the guide finger 18. Then the guide finger 18 is attached to the deck by inserting a bolt 40 through the aligned apertures 30, 38 and screwing a nut 42 on the bolt 40. The bolt 40 has a hexagonal head 44, received in the hexagonal socket 32, and a threaded end 46 connected to the nut 40. In a preferred form of the invention a metal insert 48 is provided in the aperture 30 and the socket 32. This metal insert 48 may be molded in place and protects the nylon finger 18 from being crushed or cracked when the associated bolt is tightened.

We claim:

1. A guide finger as used in a pinsetter, for guiding bowling pins into position, comprising:

a pinsetter having a deck;

said deck having a plurality of mounting apertures;

a mounting plate having a plurality of mounting apertures, said plate having a surface for engaging said deck;

a guide plate integrally joined to an edge of the mounting plate and extending at an acute angle from said mounting plate, said guide plate having a pin engaging surface;

said mounting plate and guide plate made from a slick, smooth, plastic material having a low coefficient of friction and being somewhat yieldable; and a plurality of bolts and associated nuts, said bolts extending through the mounting apertures in the mounting plate and the deck, with the associated nuts attached to a threaded end of said bolts;

wherein said bolts each include a bolt head and said mounting apertures each include a cut-out socket portion therein with the cut-out socket portions having a means for having snugly but yieldingly receiving the bolt heads therein such that overtorquing of the bolt head does not permanently deform the cut-out socket portion.

2. The guide finger of claim 1 further including a metal liner in each of said mounting apertures.

3. The guide finger of claim 1 wherein the slick, smooth material is nylon.

4. A guide finger as used in a pinsetter, for guiding bowling pins into position, comprising:

a pinsetter having a deck;

said deck having a plurality of mounting apertures;

a mounting plate having a plurality of mounting apertures, said plate having two surfaces, one surface for engaging said deck and an opposite surface remote from said deck;

a U shaped guide plate with the tope edge of the U integrally joined to an edge of the mounting plate and extending at a substantially acute angle from said mounting plate, said guide plate having a pin engaging surface;

said mounting plate and guide plate molded together from slick, smooth, plastic material such as nylon;

said mounting apertures in said mounting plate being equipped with hexagonal sockets in said opposite surface of said mounting plate;

a plurality of metal liners molded into said hexagonal sockets; and a plurality of bolts having heads and associated nuts, said bolts extending through the mounting apertures in the mounting plate and the deck, with the associated nuts attached to a threaded end of said bolts;

said mounting apertures having a means for snugly but yieldingly receiving the bolt heads therein such that overtorquing of the bolts does not permanently deform the mounting apertures.

* * * * *